US010947996B2

(12) United States Patent
Hrodey

(10) Patent No.: US 10,947,996 B2
(45) Date of Patent: Mar. 16, 2021

(54) SYSTEMS AND METHODS FOR SELECTIVE ENABLEMENT OF HYDRAULIC OPERATION

(71) Applicant: HUSCO INTERNATIONAL, INC., Waukesha, WI (US)

(72) Inventor: Kyle Hrodey, Waukesha, WI (US)

(73) Assignee: HUSCO International, Inc., Waukesha, WI (US)

( * ) Notice: Subject to any disclaimer, the term of this patent is extended or adjusted under 35 U.S.C. 154(b) by 157 days.

(21) Appl. No.: 16/249,686

(22) Filed: Jan. 16, 2019

(65) Prior Publication Data

US 2020/0224681 A1 Jul. 16, 2020

(51) Int. Cl.

| | |
|---|---|
| ***F15B 13/04*** | (2006.01) |
| ***F15B 9/09*** | (2006.01) |
| ***F15B 13/044*** | (2006.01) |

(52) U.S. Cl.

CPC ..... *F15B 9/09* (2013.01); *F15B 13/044* (2013.01); *F15B 13/0405* (2013.01); *F15B 13/0417* (2013.01); *F15B 2013/041* (2013.01); *F15B 2211/86* (2013.01)

(58) Field of Classification Search

CPC ..... F15B 13/0405; F15B 13/0417; F15B 13/0416; F15B 2211/30515; F15B 2211/605; F15B 2211/6051; F15B 2211/6057; F15B 2211/6058; F15B 2211/30565

See application file for complete search history.

(56) References Cited

U.S. PATENT DOCUMENTS 5,048,395 A * 9/1991 Ohshima ..... F15B 13/01 91/445
5,207,059 A * 5/1993 Schexnayder ..... F15B 13/0405 60/465
6,173,639 B1 * 1/2001 A'Hearn ..... F15B 11/003 91/437

(Continued)

FOREIGN PATENT DOCUMENTS

WO 2015064785 A1 5/2015

OTHER PUBLICATIONS

Trinkel Hydraulics and Pneumatics Chapter 10 (Year: 2007).*

(Continued)

*Primary Examiner* — Dustin T Nguyen
(74) *Attorney, Agent, or Firm* — Quarles & Brady LLP

(57) ABSTRACT

A hydraulic system is provided. The hydraulic system includes a pump, a load sense conduit, a tank conduit, a function workport, and a function control valve. The hydraulic system further includes a function poppet valve arranged between the function workport and the function control valve and having a function poppet vent passage, and a system control valve arranged downstream of the function control valve. The system control valve is biased into a first position where fluid communication between the function poppet vent passage and the tank conduit is prevented and fluid communication between the load sense conduit and the tank conduit is provided. The system control valve is selectively movable to a second position where fluid communication between the function poppet vent passage and the tank conduit is allowed and fluid communication between the load sense conduit and the tank conduit is prevented.

25 Claims, 5 Drawing Sheets

(56) References Cited

U.S. PATENT DOCUMENTS

| | | | | |
|---|---|---|---|---|
| 6,253,658 | B1 * | 7/2001 | Kimura | E02F 9/226 91/447 |
| 6,293,181 | B1 * | 9/2001 | Hajek, Jr. | F15B 11/024 60/478 |
| 6,371,006 | B1 * | 4/2002 | Goto | F15B 13/01 91/445 |
| 6,695,567 | B2 * | 2/2004 | Nagata | B62D 5/065 414/635 |
| 6,761,027 | B2 * | 7/2004 | A'Hearn | E02F 9/2203 60/327 |
| 6,955,115 | B1 * | 10/2005 | A'Hearn | E02F 9/2203 91/437 |
| 7,278,508 | B2 | 10/2007 | Nakada | |
| 9,518,378 | B2 * | 12/2016 | Takeuchi | E02F 9/2225 |
| 10,047,771 | B2 * | 8/2018 | Tanaka | E02F 9/2203 |
| 10,132,059 | B2 * | 11/2018 | Kubo | E02F 9/2285 |
| 2007/0210645 | A1 | 9/2007 | Dornbach | |
| 2009/0301589 | A1 * | 12/2009 | Pili | F15B 11/003 137/625.66 |
| 2018/0282974 | A1 * | 10/2018 | Kubo | F15B 13/024 |
| 2018/0347599 | A1 * | 12/2018 | Terao | F16K 1/44 |

OTHER PUBLICATIONS

RG Group What is a Poppet Valve (Year: 2017).*
Gonazalez What's the Difference Between Poppet and Piston Spool Valves (Year: 2017).*

* cited by examiner

SYSTEMS AND METHODS FOR SELECTIVE ENABLEMENT OF HYDRAULIC OPERATION

CROSS-REFERENCES TO RELATED APPLICATIONS

Not Applicable.

STATEMENT REGARDING FEDERALLY SPONSORED RESEARCH

Not Applicable.

BACKGROUND

Generally, vehicles or machines may utilize hydraulic power to manipulate a function (e.g., a hydraulic cylinder, a hydraulic motor, etc.). In some instances, an input (e.g., a joystick, a handle, a lever, etc.) may be manipulated by an operator to, for example, move one or more functions on the vehicle or machine.

BRIEF SUMMARY

In some aspect, the present disclosure provides a hydraulic system that includes a pump, a load sense conduit, a tank conduit in fluid communication with a tank, a hydraulic function having a function workport, and a function control valve configured to selectively provide fluid communication between the function workport and either the pump or the tank conduit. The hydraulic system further includes a function poppet valve arranged between the function workport and the function control valve and having a function poppet vent passage, and a system control valve arranged downstream of the function control valve. The system control valve is biased into a first position where fluid communication between the function poppet vent passage and the tank conduit is prevented and fluid communication between the load sense conduit and the tank conduit is provided. The system control valve is selectively movable to a second position where fluid communication between the function poppet vent passage and the tank conduit is allowed and fluid communication between the load sense conduit and the tank conduit is prevented.

In some aspect, the present disclosure provides a hydraulic system that includes a pump having an pump outlet, a tank conduit in fluid communication with a tank, a hydraulic function having a function workport, and a function control valve configured to selectively provide fluid communication between the function workport and either the pump or the tank conduit. The hydraulic system further includes a function poppet valve arranged between the function workport and the function control valve and having a function poppet vent passage, a system control valve arranged downstream of the function control valve, and a pump poppet valve having a pump poppet vent passage. The system control valve is biased into a first position where fluid communication between the function poppet vent passage and the tank conduit is prevented and fluid communication between the pump poppet vent passage and the tank conduit is provided. The system control valve is selectively movable to a second position where fluid communication between the function poppet vent passage and the tank conduit is allowed and fluid communication between the pump poppet vent passage and the tank conduit is prevented.

The foregoing and other aspects and advantages of the disclosure will appear from the following description. In the description, reference is made to the accompanying drawings which form a part hereof, and in which there is shown by way of illustration a preferred configuration of the disclosure. Such configuration does not necessarily represent the full scope of the disclosure, however, and reference is made therefore to the claims and herein for interpreting the scope of the disclosure.

BRIEF DESCRIPTION OF DRAWINGS

The invention will be better understood and features, aspects and advantages other than those set forth above will become apparent when consideration is given to the following detailed description thereof. Such detailed description makes reference to the following drawings.

DETAILED DESCRIPTION

The use of the terms "downstream" and "upstream" herein are terms that indicate direction relative to the flow of a fluid. The term "downstream" corresponds to the direction of fluid flow, while the term "upstream" refers to the direction opposite or against the direction of fluid flow The present disclosure provides hydraulic systems and methods that allow the selective disabling or enabling of hydraulic operation on machines/vehicles (e.g., forklifts and off-highway vehicles, such as, excavators, skid steers, backhoe loaders, loaders, etc.) with hydraulically-operated functions (e.g., a hydraulic actuator, a hydraulic motor, a hydraulic piston and cylinder, etc.). Typically, the hydraulically-operated functions may be coupled to an implement (e.g., a mast, a boom, a bucket, tracks, wheels, etc.), and an operator may be able to selectively move the implement via manipulation of an input mechanism (e.g., a lever, a joystick, etc.). When an operator is not present (e.g., not seated on an operator seat, not standing within an operator compartment, or not present at a remote command station), it is desirable to disable hydraulic operation of the functions (manually and pilot operated functions), such that function operation is disabled if, for example, the pump is operating normally and/or an input mechanism is inadvertently manipulated.

Conventional hydraulic system typically include a mechanism that interrupts pilot supply pressure to the pilot-operated functions (e.g., joystick operated functions). This may prevent a pilot-operated function from being commanded, but does not work on manually-operated valves due to a physical linkage between the manual input (e.g., a lever) and the spool of the valve.

Generally, the hydraulic systems and methods disclosed herein include a simplified solution for selectively disabling manually and pilot operated functions, even when the pump is operating normally and/or if an input mechanism (e.g., a lever) is inadvertently manipulated. In some non-limiting examples, a hydraulic system may include a single electro-hydraulic control valve that may be selectively moved from a first position and a section position to transition both manually and pilot operated hydraulic functions on a machine/vehicle from a disabled state to an enabled state. In this way, for example, the complexity and costs associated with selectively disabling hydraulic functions in conventional hydraulic system may be substantially reduced.

Figure 1:
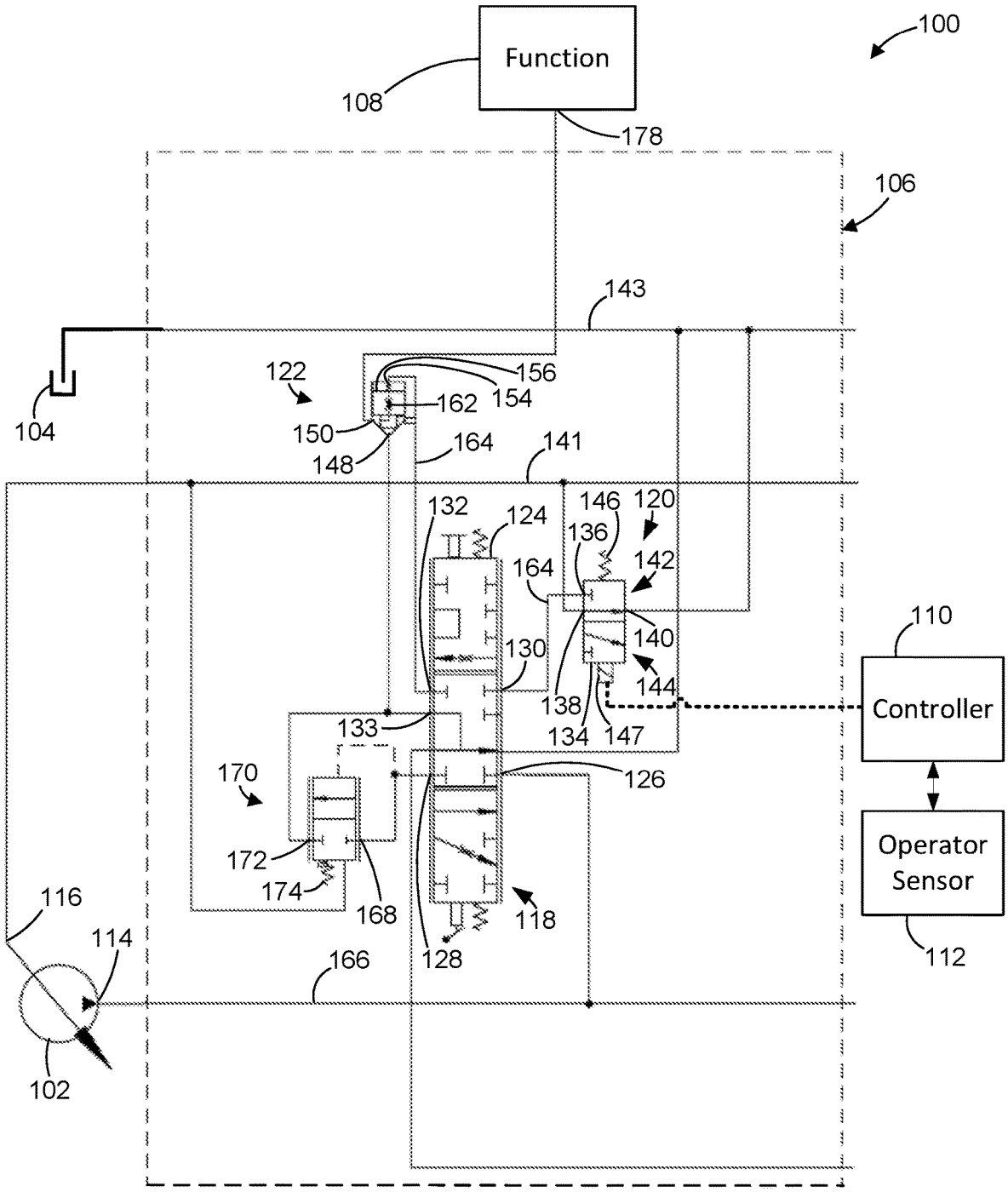
FIG. 1 is a hydraulic schematic of a hydraulic system according to one aspect of the present disclosure.
Figure 2:
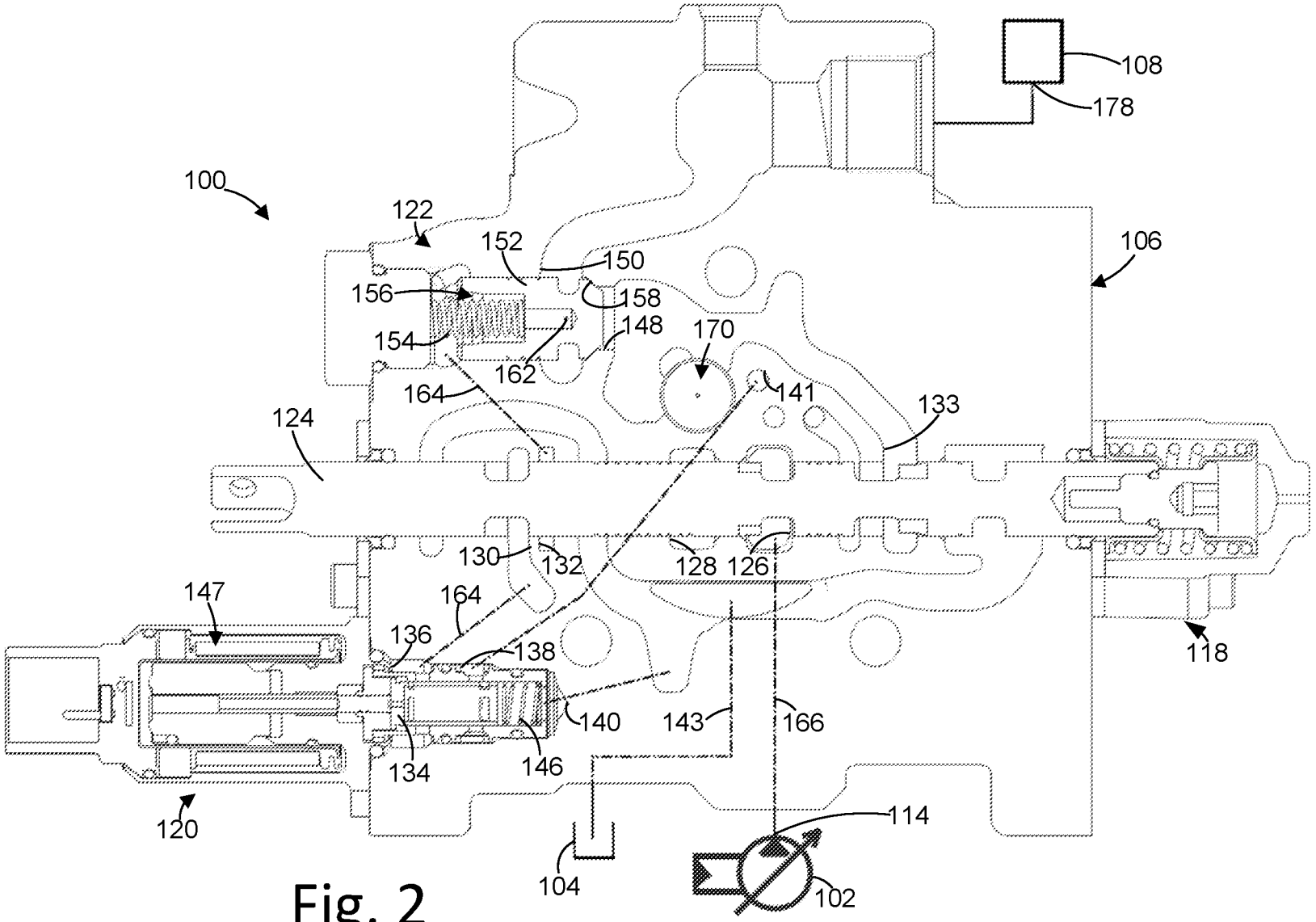
FIG. 2 is a plan view of a control valve assembly of the hydraulic system of FIG. 1.

FIGS. 1 and 2 illustrate one non-limiting example of a hydraulic system 100 according to the present disclosure. In the illustrated non-limiting example, the hydraulic system 100 may include a pump 102, a tank 104, a control valve assembly 106, a function 108, a controller 110, and an operator sensor 112. The pump 102 may be driven by drive mechanism (e.g., an internal combustion engine, an electric motor, etc.), and may be configured to draw fluid, such as oil, from the tank 104 and furnish the fluid under increased pressure at a pump outlet 114. In the illustrated non-limiting example, the pump 102 may include a load sense port 116 used to vary the pressure at the pump outlet 114 of the pump 102. In other non-limiting examples, the pump 102 may be a fixed displacement pump, as will be described herein.

In the illustrated non-limiting example, the control valve assembly 106 may include a function control valve 118, a system control valve 120, and a function poppet valve 122. The ends of the dash-dot-dash lines in FIG. 2 illustrate connections between ports that occur through the control valve assembly 106 (e.g., through a manifold or a control valve body) that are not shown in the plane of FIG. 2. In general, the function control valve 118 may be configured to control a flow of fluid between the function 108 and both of the pump 102 and the tank 104. In some non-limiting examples, the function control valve 118 may include a spool 124, a first function control valve workport 126, a second function control valve workport 128, a third function control valve workport 130, a fourth function control valve workport 132, and a fifth function control valve workport 133. In the illustrated non-limiting example, the function control valve 118 may be manually operated via the manipulation of a lever or handle. In some non-limiting examples, the function control valve 118 may be electronically or electrohydraulically operated. In any case, selectively manipulation of the function control valve 118 may move the spool 124 to control operation of the function 108. In general, the function control valve 118 may be manipulated (i.e., displaced) either in a first direction (i.e., upward from the perspective of FIG. 1) or a second direction (i.e., downward from the perspective of FIG. 1). When the function control valve 118 is displaced in the first direction, fluid communication is provided between the third function control valve workport 130 and the fourth function control valve workport 132, and fluid communication is provided between the fifth function control valve workport 133 and the tank 104. When the function control valve 118 is displaced in the second direction, fluid communication is provided between the first function control valve workport 126 and the second function control valve workport 128.

In the illustrated non-limiting example, the system control valve 120 may be in the form on a 3-way, 2-position control valve. In some non-limiting examples, the system control valve 120 may be solenoid operated. In some non-limiting examples, the system control valve 120 may be electrically operated, for example, via electrical communication with the controller 110. The system control valve 120 may include a system control valve spool 134, a first port 136, a second port 138, and a third port 140. The first port 136 may be in fluid communication with the third function control valve workport 130, the second port 138 may be in fluid communication with a load sense conduit 141, and the third port 140 may be in fluid communication with a tank conduit 143. The load sense conduit 141 may be in fluid communication with the load sense port 116 of the pump 102. The tank conduit 143 may be in fluid communication with the tank 104.

In operation, the system control valve 120 may be selectively movable between a first position 142 and a second position 144. When the system control valve 120 is in the first position 142, the first port 136 may be blocked and fluid communication may be provided between the second port 138 and the third port 140. When the system control valve 120 is in the second position 144, the second port 138 may be blocked and fluid communication may be provided between the first port 136 and the third port 140. The system control valve 120 may be normally biased into the first position 142 by a spring 146. A solenoid 147 coupled to an opposing end of the system control valve spool 134 from the spring 146 may be configured to selectively move the system control valve 120 from the first position 142 to the second position 144, for example, in response to a signal from the controller 110.

The function poppet valve 122 may include a first poppet port 148, a second poppet port 150, a poppet 152, a poppet spring 154, and a control chamber 156. The poppet 152 may be biased against a seat 158 by the poppet spring 154. An internal passage through the poppet 152 may include an orifice 162 and may provide fluid communication between the second poppet port 150 and the control chamber 156. The control chamber 156 may be in fluid communication with a function poppet vent passage 164. The function poppet vent passage 164 may extend from the control chamber 156 to the fourth function control valve workport 132. When the function control valve 118 is displaced in the first direction, the function poppet vent passage 164 may then extend from the third function control valve workport 130 to the first port 136 of the system control valve 120. When the function control valve 118 is not displaced in the first direction (e.g., in the centered, normal position, or displaced in the second direction), the function poppet vent passage 164 may be blocked at the fourth function control valve workport 132.

In the illustrated non-limiting example, the first function control valve workport 126 may be in fluid communication with a supply conduit 166. The supply conduit 166 may be in fluid communication with the pump outlet 114. The second function control valve workport 128 may be in fluid communication with a first compensator port 168 of a compensator control valve 170. A second compensator port 172 of the compensator control valve 170 may be in fluid communication with the first poppet port 148. The compensator control valve 170 may be normally biased into a first position by a spring 174. In the first position, the compensator control valve 170 may prevent fluid communication between the first compensator port 168 and the second compensator port 172. The compensator control valve 170 may be movable between the first position and a second position, where fluid communication is provided between the first compensator port 168 and the second compensator port 172, in response to a force balance between the spring 174 and a pressure differential between a pressure at a location between the second function control valve workport 128 and the first compensator port 168 and a pressure in the load sense conduit 141.

In the illustrated non-limiting example, the function 108 may include a function workport 178. The function workport 178 may be in fluid communication with the second poppet port 150. In some non-limiting examples, the function 108 may include more than one function workport 178 (e.g., a double-acting piston/cylinder).

In the illustrated non-limiting example, the controller 110 may be in electrical communication with the solenoid 147 of the system control valve 120 and the operator sensor 112. In some non-limiting examples, the operator sensor 112 may be configured to sense a presence of an operator. For example, the operator sensor 112 may be a weight sensor or an optical sensor configured to sense an operator's presence within a machine/vehicle on which the hydraulic system 100 is installed. In some non-limiting examples, the operator sensor 112 may be a switch moved by an operator. In any case, the operator sensor 112 may be configured to provide an output to the controller 110 that indicates whether an operator is present and ready to operate the machine/vehicle. In operation, the controller 110 may be configured to instruct the system control valve 120 to move from the first position 142 to the second position 144 in response to a positive operator presence indication provided by the operator sensor 112.

One non-limiting example of the operation of the hydraulic system 100 will be described with reference to FIGS. 1 and 2. When the operator sensor 112 provides a negative operator presence indication, the controller 110 does not send a signal to the solenoid 147 of the system control valve 120. The spring 146, therefore, biases the system control valve 120 into the first position 142. With the system control valve 120 in the first position 142, fluid communication is provided between the load sense conduit 141 and the tank conduit 143. In this way, the pressure supplied by the pump 102 at the pump outlet 114 may be prevented from building above a pump margin pressure. With the pump pressure prevented from building above margin pressure, operation of the function 108 via connection of the function workport 178 to the supply conduit 166 (i.e., displacing the function control valve 118 in the second direction) may be prevented. For example, in some applications, the margin pressure may be not be of sufficient magnitude to result in displacement of the function 108. That is, the margin pressure may not be greater than a function load pressure acting on the pressure at the second poppet port 150, which is in fluid communication with the function workport 178. However, if a pump pressure below margin pressure is required to prevent displacement of the function 108 (e.g., the margin pressure may be greater than a function load pressure acting on the second poppet port 150), a pump poppet may be integrated into the hydraulic system to selectively lower the pump pressure to below margin pressure as will be described herein.

In addition, with the system control valve 120 in the first position 142, fluid communication between the function poppet vent passage 164 and the tank 104 is prevented. In the illustrated non-limiting example, the system control valve 120 may be arranged downstream of the function control valve 118. That is, fluid flows in a direction from the function workport 178 through the orifice 162 and along the function poppet vent passage 164 to the fourth function control valve workport 132 and, if the function control valve 118 is displaced in the first direction, from the third function control valve workport 130 to the first port 136 of the system control valve 120. Therefore, when the system control valve 120 is in the first position 142 and the first port 136 is blocked, fluid communication from the function poppet vent passage 164 to the tank conduit 143 is always blocked, even if the function control valve 118 is displaced in the first direction. In this way, the control chamber 156 of the function poppet valve 122 may be prevented from being fluidly connected to the tank 104, and the pressure from the function workport 178 may be communicated through the orifice 162 into the control chamber 156. The force of the workport pressure and the poppet spring 154 may bias the poppet 152 into engagement with the seat 158, which blocks fluid flow from the first poppet port 148 to the second poppet port 150, even if the function control valve 118 is displaced in the first direction.

If the function control valve 118 is displaced in the second direction, the first function control valve workport 126 may be in fluid communication with the second function control valve workport 128, which may provide fluid communication between the pump outlet 114 and the first poppet port 148. In some applications, a function load pressure acting on the second poppet port 150 may be greater than the pump margin pressure at the pump outlet 114. In these applications, with the pump 102 prevented from building above margin pressure, the pressure at the second poppet port 150, and thereby the pressure in the control chamber 156, may be greater than the pressure at the first poppet port 148. Thus, the greater pressure in the control chamber 156 and the force of the spring 154 may hold the poppet 152 in engagement with the seat 158, and prevent the function 108 from displacing, even if the function control valve 118 is displaced in the second direction. In some applications, the pump margin pressure may be greater than a function load pressure acting on the second poppet port 150. In these applications, a pump poppet may be integrated into the hydraulic system to selectively lower the pump pressure to below margin pressure and below the function load pressure as will be described herein.

In some non-limiting examples, the function 108 may apply a load at the function workport 178 (e.g., the force of gravity or another weight applied to the function 108). With the function poppet valve 122 blocking fluid flow from the function workport 178 to the function control valve 118 when the system control valve 120 is in the first position 142, the function poppet valve 122 may be configured to hold a load applied by the function 108 to the function workport 178 and, thereby, prevent the function 108 from displacing due to the load applied thereto. As described above, the function 108 may also be prevented from displacing due to pump pressure supplied to the function workport 178 by the connection between the load sense conduit 141 and the tank conduit 143 provided by the system control valve 120 in the first position 142. As such, when the system control valve 120 is in the first position 142, operation of the function 108 via manipulation of the function control valve 118 may be prevented.

In one non-limiting example, the function 108 may be a hydraulic actuator. In this non-limiting example, when the system control valve 120 is in the first position 142, the actuator may be prevented from moving in a one direction (e.g., raise) by the connection between the load sense conduit 141 and the tank conduit 143, and the actuator may be prevented from moving in another direction (e.g., lower) by blocking the function poppet vent passage 164 from connecting to the tank conduit 143. Thus, the hydraulic actuator may be prevented from moving (e.g., the piston may be prevented from extending to raise the function or retracting to lower the function), even if the function control valve 118 is manipulated (i.e., displaced in the first direction or the second direction).

When the operator sensor 112 provides a positive operator presence indication, the controller 110 may send a signal to the solenoid 147 of the system control valve 120, which results in the system control valve 120 moving from the first position 142 to the second position 144. With the system control valve 120 in the second position 144, the second port 138 may be blocked and fluid communication between the load sense conduit 141 and the tank 104 may be prevented. In this way, the pump 102 may be allowed to build pump pressure and, when the function control valve 118 is displaced in the second direction, fluid communication may be provided from the supply conduit 166 to the second function control valve workport 128. This may increase the pressure at a location between the second function control valve workport 128 and the first compensator port 168 to a sufficient magnitude to move the compensator valve from the first position to the second position, and supply fluid to the first poppet port 148. The fluid pressure supplied to the first poppet port 148 from the supply conduit 166 may overcome the force of the poppet spring 154 and force the poppet 152 of the function poppet valve 122 off of the seat 158. In this way, fluid communication may be provided between the first poppet port 148 and the second poppet port 150 and, thereby to the function workport 178. The fluid supplied from the supply conduit 166 to the function workport 178 may move the function 108 in a desired direction to perform a desired task (e.g., raise).

In addition, when the system control valve 120 is in the second position 144, the first port 136 may be connected to the third port 140, which allows fluid communication between the function poppet vent passage 164 and the tank 104. For example, with the function poppet vent passage 164 extending through the function control valve 118, the fluid communication between the function poppet vent passage 164 and the tank 104 may occur once the function control valve 118 is displaced in the first direction, where fluid communication is provided between the fourth function control valve workport 132 and the third function control valve workport 130. Once fluid communication is provided between the function poppet vent passage 164 and the tank 104, the pressure in the control chamber 156 may be reduced to the tank pressure, and the function workport pressure acting on the second poppet port 150 may overcome the force of the poppet spring 154 to bias the poppet 152 off of the seat 158, which provides fluid communication between the second poppet port 150 and the first poppet port 148. In this way, fluid communication may be provided between the function workport 178 and the fifth function control valve workport 133. With the function control valve 118 displaced in the first direction, fluid communication is provided between the fifth function control valve workport 133 and the tank conduit 143, which provides fluid communication between the function workport 178 and the tank 104. In this way, the function 108 may be allowed to move in a desired direction to perform a desired task (e.g., lower). Thus, with the system control valve 120 in the second position 144, operation of the function 108 via manipulation of the function control valve 118 is allowed.

The use of the system control valve 120 within the hydraulic system 100 provides a simple and low-cost solution for selectively enabling or disabling hydraulic operation thereof. For example, the system control valve 120 is a single component that may be selectively actuated in response to the operator sensor 112 to enable hydraulic operation of the function 108. Absent a positive operator presence indication from the operator sensor 112, the system control valve 120 is configured to disable hydraulic operation of the function 108 by itself, even if the function control valve 118 is manipulated. In addition, the system control valve 120 utilizes a 3-way, 2-position valve design, which is substantially simplified when compared to conventional solutions that require multiple valves or complex spool designs.

Figure 3:
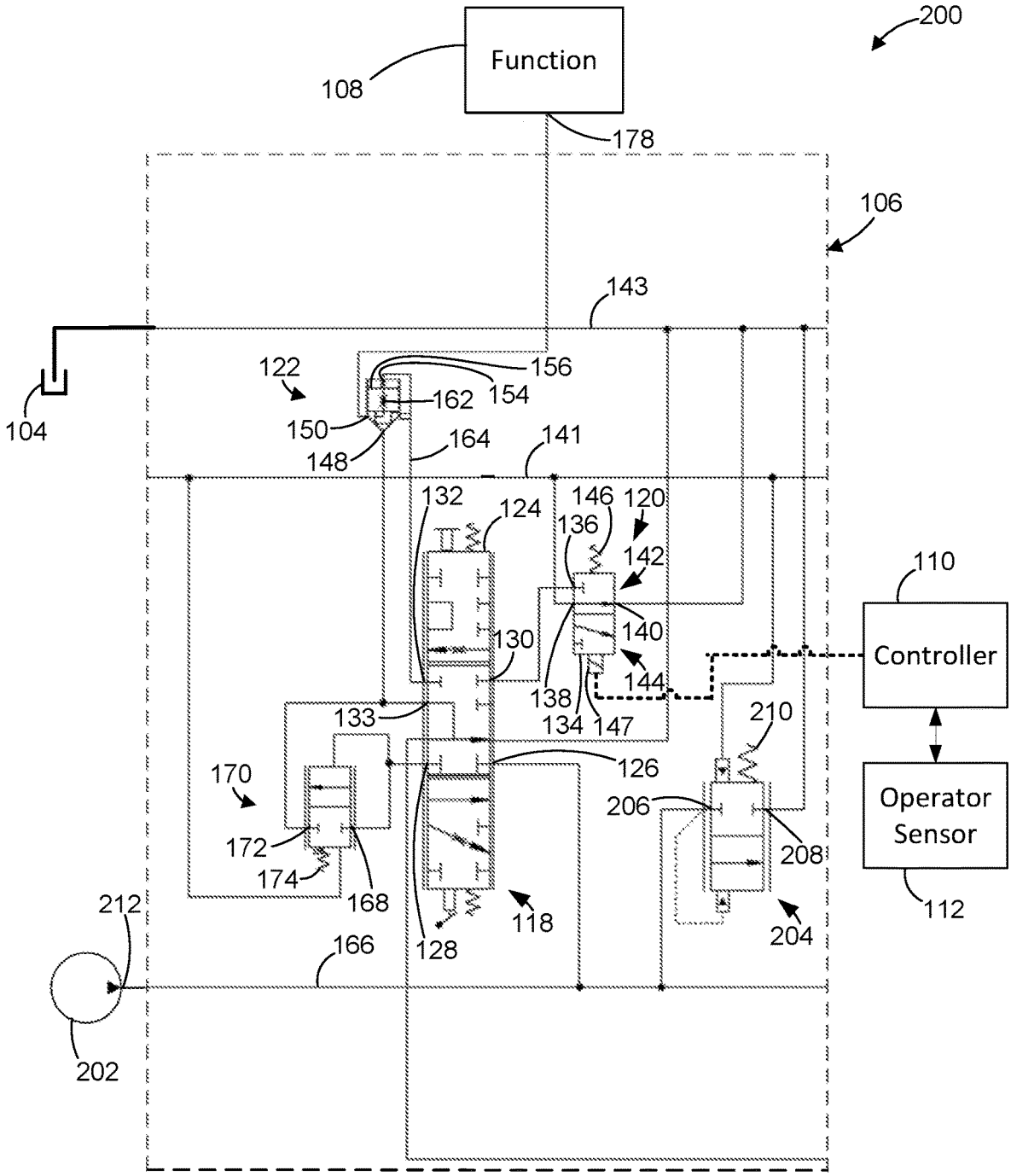
FIG. 3 is a hydraulic schematic of a hydraulic system according to another aspect of the present disclosure.

The hydraulic system 100 of FIGS. 1 and 2 illustrates the use of the system control valve 120 with a variable displacement pump. It should be appreciated that the functionality of the system control valve 120 may also be applied to a fixed displacement pump. FIG. 3 illustrates one non-limiting example of a hydraulic system 200 where the system control valve 120 is implemented with a fixed displacement pump 202. The hydraulic system 200 may be similar in design and functionality to the hydraulic system 100, with similar elements identified using like reference numerals, except as described below or as apparent from the figures. In the illustrated non-limiting example, the hydraulic system 200 may include an unloader valve 204 having a first unloader port 206 and a second unloader port 208. The unloader valve 204 may be biased into a first position by a spring 210. In operation, the unloader valve 204 may be moveable between the first position where fluid communication is inhibited between the first unloader port 206 and the second unloader port 208, and a second position where fluid communication is provided between the first unloader port 206 and the second unloader port 208.

In the illustrated non-limiting example, the unloader valve 204 may be movable from the first position to the second position when a pressure at the first unloader port 206 provides a force greater than a combined force of the spring 210 and a pressure in the load sense conduit 141. The first unloader port 206 may be in fluid communication with the supply conduit 166 and, thereby, a pump outlet 212 of the pump 202. The second unloader port 208 may be in fluid communication with the tank conduit 143 and, thereby, the tank 104. In general, during operation, the unloader valve 204 may selectively open and close the fluid path between the first unloader port 206 and the second unload port 208 to restrict flow until the pump supply pressure at the first unloader port 206 is balanced by the combined force of the spring 210 and the pressure in the load sense conduit 141. In this way, for example, the pump pressure may be controlled to a "margin" above the pressure within the load sense conduit 141.

The operation of the hydraulic system 200 may be similar to the operation of the hydraulic system 100, described above, except as described below or as apparent from the figures. In operation, when the system control valve 120 is in the first position 142, the fluid communication between the load sense conduit 141 and the tank conduit 143 may not directly act on the pump 202, like the connection between the load sense conduit 141 and the load sense port 116 of the pump 102. Rather, the reduction in pressure within the load sense conduit 141 to tank pressure may result in the unloader valve 204 moving from the first position to the second position, where fluid communication is provided between the pump outlet 212 and the tank 104. That is, the combined force of the pressure in the load sense conduit 141 and the spring 210 may be reduced by the drop in pressure within the load sense conduit 141, and the pressure at the first unloader port 206 (i.e., pump supply pressure) may force the unloader valve 204 to move to the second position. With fluid communication provided between the pump outlet 212 and the tank 104, the pump 202 may be prevented from building pressure and the pressure at the pump outlet 114 may be kept low (e.g., below "margin" pressure and/or below the function load pressure acting on the second poppet port 150). In this way, the function 108 may be prevented from displacing due to the pump pressure being supplied to the function workport 178, even if the function control valve 118 is displaced in the second direction.

Figure 4:
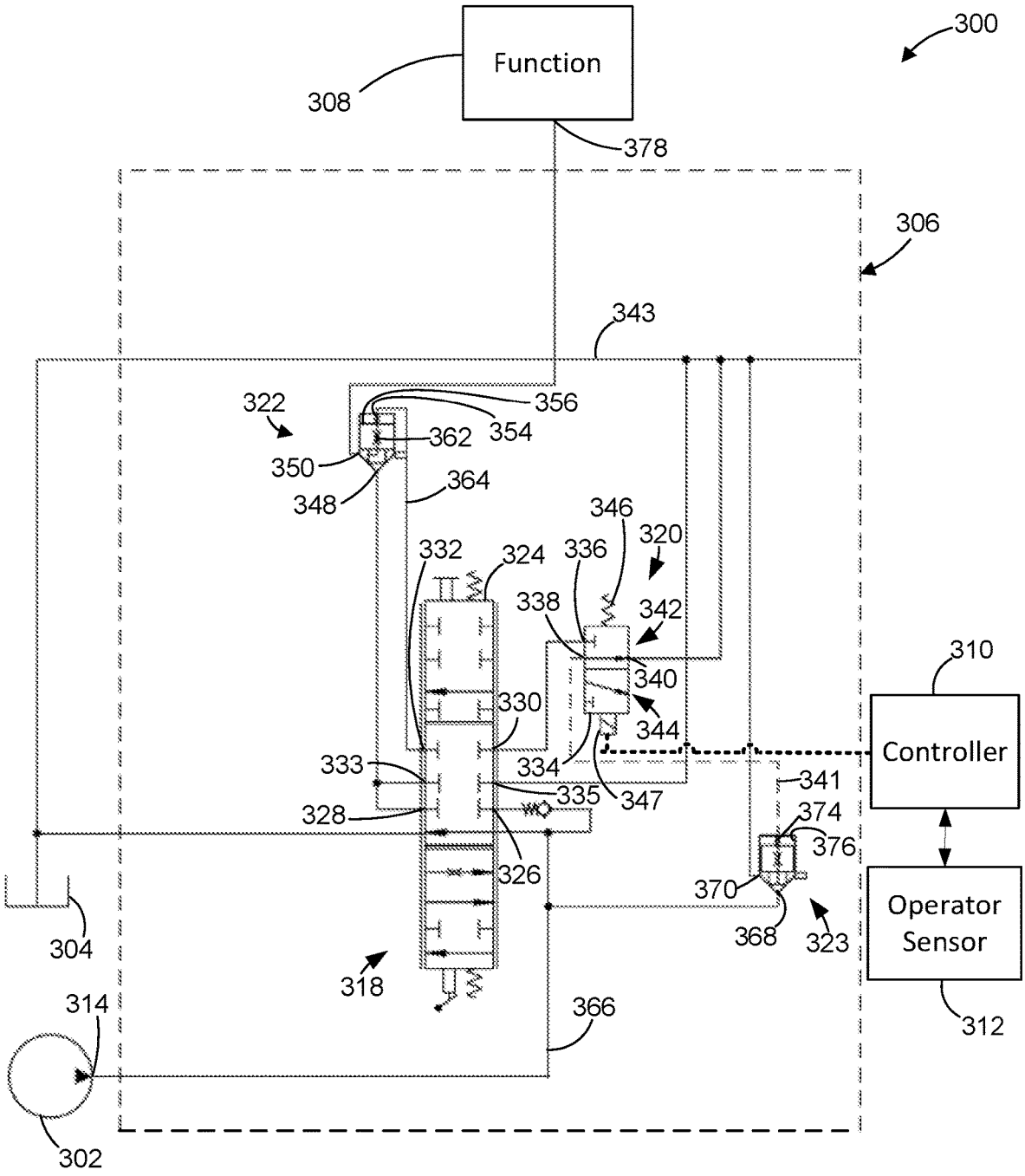
FIG. 4 is a hydraulic schematic of a hydraulic system according to another aspect of the present disclosure.
Figure 5:
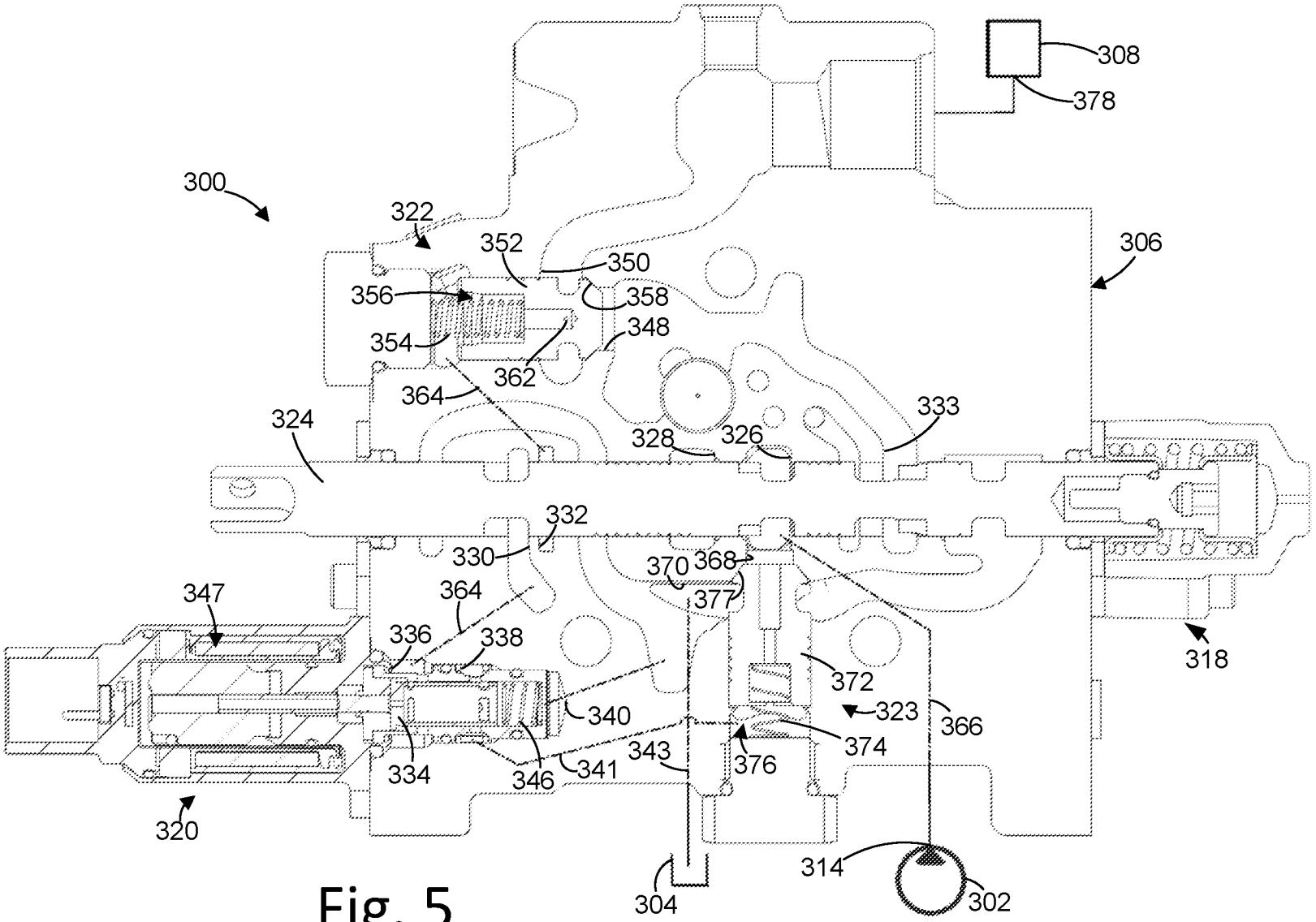
FIG. 5 is a plan view of a control valve assembly of the hydraulic system of FIG. 4.

FIGS. 4 and 5 illustrate one non-limiting example of a hydraulic system 300 according to the present disclosure. In the illustrated non-limiting example, the hydraulic system 300 may include a pump 302, a tank 304, a control valve assembly 306, a function 308, a controller 310, and an operator sensor 312. The pump 302 may be driven by drive mechanism (e.g., an internal combustion engine, an electric motor, etc.), and may be configured to draw fluid, such as oil, from the tank 304 and furnish the fluid under increased pressure at a pump outlet 314. In the illustrated non-limiting example, the pump 302 may be a fixed displacement pump. In some non-limiting examples, the pump 302 may be a variable displacement pump.

In the illustrated non-limiting example, the control valve assembly 306 may include a function control valve 318, a system control valve 320, a function poppet valve 322, and a pump poppet valve 323. The ends dash-dot-dash lines in FIG. 5 illustrate connections between ports that occur through the control valve assembly 306 (e.g., through a manifold or a control valve body) that are not shown in the plane of FIG. 5. In general, the function control valve 318 may be configured to control a flow of fluid between the function 308 and both of the pump 302 and the tank 304. In some non-limiting examples, the function control valve 318 may include a spool 324, a first function control valve workport 326, a second function control valve workport 328, a third function control valve workport 330, a fourth function control valve workport 332, a fifth function control valve workport 333, and a sixth function control valve workport 335. In the illustrated non-limiting example, the function control valve 318 may be manually operated via the manipulation of a lever or handle. In some non-limiting examples, the function control valve 318 may be electronically or electrohydraulically operated. In any case, selectively manipulation of the function control valve 318 may move the spool 324 to control operation of the function 308. In general, the function control valve 318 may be manipulated (i.e., displaced) either in a first direction (i.e., upward from the perspective of FIG. 4) or a second direction (i.e., downward from the perspective of FIG. 4). When the function control valve 318 is displaced in the first direction, fluid communication is provided between the third function control valve workport 330 and the fourth function control valve workport 332, and fluid communication is provided between the fifth function control valve workport 333 and the sixth function control valve workport 335. When the function control valve 318 is displaced in the second direction, fluid communication is provided between the first function control valve workport 326 and the second function control valve workport 328.

In the illustrated non-limiting example, the system control valve 320 may be in the form on a 3-way, 2-position control valve. In some non-limiting examples, the system control valve 320 may be solenoid operated. In some non-limiting examples, the system control valve 320 may be electrically operated, for example, via electrical communication with the controller 310. The system control valve 320 may include a system control valve spool 334, a first port 336, a second port 338, and a third port 340. The first port 336 may be in fluid communication with the third function control valve workport 330, the second port 338 may be in fluid communication with a pump poppet vent passage 341 of the pump poppet valve 323, and the third port 340 may be in fluid communication with a tank conduit 343. The tank conduit 343 may be in fluid communication with the tank 304.

In operation, the system control valve 320 may be selectively movable between a first position 342 and a second position 344. When the system control valve 320 is in the first position 342, the first port 336 may be blocked and fluid communication may be provided between the second port 338 and the third port 340. When the system control valve 320 is in the second position 344, the second port 338 may be blocked and fluid communication may be provided between the first port 336 and the third port 340. The system control valve 320 may be normally biased into the first position 342 by a spring 346. A solenoid 347 coupled to an opposing end of the system control valve spool 334 from the spring 346 may be configured to selectively move the system control valve 320 from the first position 342 to the second position 344, for example, in response to a signal from the controller 310.

The function poppet valve 322 may include a first poppet port 348, a second poppet port 350, a poppet 352, a poppet spring 354, and a control chamber 356. The poppet 352 may be biased against a seat 358 by the poppet spring 354. An internal passage through the poppet 352 may include an orifice 362 and may provide fluid communication between the second poppet port 350 and the control chamber 356. The control chamber 356 may be in fluid communication with a function poppet vent passage 364. The function poppet vent passage 364 may extend from the control chamber 356 to the fourth function control valve workport 332, and then from the third function control valve workport 330 to the first port 336 of the system control valve 320.

In the illustrated non-limiting example, the first function control valve workport 326 may be in fluid communication with a supply conduit 366. The supply conduit 366 may be in fluid communication with the pump outlet 314. The second function control valve workport 328 and the fifth function control valve workport 333 may be in fluid communication with the first poppet port 348.

In the illustrated non-limiting example, the pump poppet valve 323 may include a first pump poppet port 368, a second pump poppet port 370, a pump poppet 372, a pump poppet spring 374, and a pump control chamber 376. The pump poppet 372 may be biased against a pump poppet seat 377 by the pump poppet spring 374. An internal passage through the pump poppet 372 may include an orifice 379 and may provide fluid communication between the first pump poppet port 368 and the pump control chamber 376. The pump control chamber 376 may be in fluid communication with the pump poppet vent passage 341. The pump poppet vent passage 341 may extend from the pump control chamber 376 to the second port 338 of the system control valve 320. In the illustrated non-limiting example, the first pump poppet port 368 may be in fluid communication with the supply conduit 366, and the second pump poppet port 370 may be in fluid communication with the tank conduit 343.

In the illustrated non-limiting example, the function 308 may include a function workport 378. The function workport 378 may be in fluid communication with the second poppet port 350. In some non-limiting examples, the function 308 may include more than one function workport 378 (e.g., a double-acting piston/cylinder).

In the illustrated non-limiting example, the controller 310 may be in electrical communication with the solenoid 347 of the system control valve 320 and the operator sensor 312. In some non-limiting examples, the operator sensor 312 may be configured to sense a presence of an operator. For example, the operator sensor 312 may be a weight sensor or an optical sensor configured to sense an operator's presence within a machine/vehicle on which the hydraulic system 300 is installed. In some non-limiting examples, the operator sensor 312 may be a switch moved by an operator. In any case, the operator sensor 312 may be configured to provide an output to the controller 310 that indicates whether an operator is present and ready to operate the machine/vehicle. In operation, the controller 310 may be configured to instruct the system control valve 320 to move from the first position 342 to the second position 344 in response to a positive operator presence indication provided by the operator sensor 312.

One non-limiting example of the operation of the hydraulic system 300 will be described with reference to FIGS. 4 and 5. When the operator sensor 312 provides a negative operator presence indication, the controller 310 does not send a signal to the solenoid 347 of the system control valve 320. The spring 346, therefore, biases the system control valve 320 into the first position 342. With the system control valve 320 in the first position 342, the second port 338 may be connected to the third port 340, which provides fluid communication between pump poppet vent passage 341 and the tank conduit 343 and, thereby, the tank 304. Once fluid communication is provided between the pump poppet vent passage 341 and the tank 304, the pressure in the pump control chamber 376 may be reduced to tank pressure, and the pump supply pressure from the supply conduit 366 acting on the first pump poppet port 368 may overcome the force of the pump poppet spring 374 to bias the pump poppet 372 off of the pump poppet seat 377. With the pump poppet 372 biased off of the pump poppet seat 377, fluid communication may be provided between the first pump poppet port 368 and the second pump poppet port 370. In this way, fluid communication may be provided between the pump outlet 314 and the tank 304, which prevents the pump 302 from building supply pressure and keeps the pressure at the pump outlet 314 low (e.g., lower than a function load pressure). With the pump pressure prevented from building, operation of the function 308 via connection of the function workport 378 to the supply conduit 366 (i.e., displacing the function control valve 318 in the second direction) may be prevented.

In addition, with the system control valve 320 in the first position 342, fluid communication between the function poppet vent passage 364 and the tank 304 is prevented. In the illustrated non-limiting example, the system control valve 320 may be arranged downstream of the function control valve 318. That is, fluid flows in a direction from the function workport 378 through the orifice 362 and along the function poppet vent passage 364 to the fourth function control valve workport 332 and, if the function control valve 318 is displaced in the first direction, from the third function control valve workport 330 to the first port 336 of the system control valve 320. Therefore, when the system control valve 320 is in the first position 342 and the first port 336 is blocked, fluid communication from the function poppet vent passage 364 to the tank conduit 343 is always blocked, even if the function control valve 318 is displaced. In this way, the control chamber 356 of the function poppet valve 322 may be prevented from being fluidly connected to the tank 304, and the pressure from the function workport 378 may be communicated through the orifice 362 into the control chamber 356. The force of the workport pressure and the poppet spring 354 may bias the poppet 352 into engagement with the seat 358, which blocks fluid flow from the first poppet port 348 to the second poppet port 350.

If the function control valve 318 is displaced in the second direction, the first function control valve workport 326 may be in fluid communication with the second function control valve workport 328, which may provide fluid communication between the pump outlet 314 and the first poppet port 348. With the pump pressure kept low via the connection of the pump outlet 314 to the tank 304 via the pump poppet 323, the pressure supplied from the second function control valve workport 328 to the first poppet port 348 may be less than the function load pressure applied to the second poppet port 350, which is communicated to the control chamber 356. Thus, the greater pressure in the control chamber 356 and the force of the spring 354 may hold the poppet 352 in engagement with the seat 358, and prevent the function 308 from displacing, even if the function control valve 318 is displaced in the second direction.

In some non-limiting examples, the function 308 may apply a load at the function workport 378 (e.g., the force of gravity or another weight applied thereto). With the function poppet valve 322 blocking fluid flow from the function workport 378 to the function control valve 318 when the system control valve 320 is in the first position 342, the function poppet valve 322 may be configured to hold a load applied by the function 308 to the function workport 378 and, thereby, prevent the function 308 from displacing due to the load applied thereto. As described above, the function 308 may also be prevented from displacing due to pump pressure supplied to the function workport 378 by the connection between the pump poppet vent passage 341 and the tank conduit 343 provided by the system control valve 320 in the first position 342. As such, when the system control valve 320 is in the first position 342, operation of the function 308 via manipulation of the function control valve 318 may be prevented.

In one non-limiting example, the function 308 may be a hydraulic actuator. In this non-limiting example, when the system control valve 320 is in the first position 342, the actuator may be prevented from moving in a one direction (e.g., raise) by the connection between the pump poppet vent passage 341 and the tank conduit 343, and the actuator may be prevented from moving in another direction (e.g., lower) by blocking the function poppet vent passage 364 from connecting to the tank conduit 343. Thus, the hydraulic actuator may be prevented from moving (e.g., the piston may be prevented from extending to raise the function or retracting to lower the function), even if the function control valve 318 is manipulated (i.e., displaced in the first direction or the second direction).

When the operator sensor 312 provides a positive operator presence indication, the controller 310 may send a signal to the solenoid 347 of the system control valve 320, which results in the system control valve 320 moving from the first position 342 to the second position 344. With the system control valve 320 in the second position 344, the second port 338 may be blocked, which blocks fluid communication between the pump poppet vent passage 341 and the tank 304. The pressure from pump supply pressure within the supply conduit 366 may then be communicated through the orifice 379 into the pump control chamber 376. The force of the pump supply pressure and the pump poppet spring 374 may bias the pump poppet 372 into engagement with the pump poppet seat 377, which blocks fluid flow from the first pump poppet port 368 to the second pump poppet port 370. Blocking fluid flow between the first pump poppet port 368 and the second pump poppet port 370 also blocks fluid flow from the pump outlet 314 to the tank 104 through the pump poppet valve 323.

In this way, the pump 302 may be allowed to build pump pressure and, when the function control valve 318 is displaced in the second direction, fluid communication may be provided from the supply conduit 366 to the second function control valve workport 328. Fluid may then flow from the second function control valve workport 328 to the first poppet port 348. The fluid pressure supplied to the first poppet port 348 from the supply conduit 366 may overcome the force of the poppet spring 354 and force the poppet 352 of the function poppet valve 322 off of the seat 358. In this way, fluid communication may be provided between the first poppet port 348 and the second poppet port 350 and, thereby, to the function workport 378. The fluid supplied from the supply conduit 366 to the function workport 378 may move the function 308 in a desired direction to perform a desired task (e.g., raise).

In addition, when the system control valve 320 is in the second position 344, the first port 336 may be connected to the third port 340, which allows fluid communication between the function poppet vent passage 364 and the tank 304. For example, with the function poppet vent passage 364 extending through the function control valve 318, the fluid communication between the function poppet vent passage 364 and the tank 304 may occur once the function control valve 318 is displaced in the first direction. Once fluid communication is provided between the function poppet vent passage 364 and the tank 304, the pressure in the control chamber 356 may be reduced to the tank pressure, and the function workport pressure acting on the second poppet port 350 may overcome the force of the poppet spring 354 to provide fluid communication between the second poppet port 350 and the first poppet port 348. In this way, fluid communication may be provided between the function workport 378 and the fifth function control valve workport 333. With the function control valve 318 displaced in the first direction, fluid communication may be provided between the fifth function control valve workport 333 and the sixth function control valve workport 335, which is in fluid communication with the tank conduit 143. In this way, the function workport 378 may be in fluid communication with the tank 304, and the function 308 may be allowed to move in a desired direction to perform a desired task (e.g., lower). Thus, with the system control valve 320 in the second position 144, operation of the function 308 via manipulation of the function control valve 318 may be allowed.

The use of the system control valve 320 within the hydraulic system 300 provides a simple and low-cost solution for selectively enabling hydraulic operation thereof. For example, the system control valve 320 is a single component that may be selectively actuated in response to the operator sensor 312 to enable hydraulic operation of the function 308. Absent a positive operator presence indication from the operator sensor 312, the system control valve 320 is configured to disable hydraulic operation of the function 308 by itself, even if the function control valve 318 is manipulated. In addition, the system control valve 320 utilizes a 3-way, 2-position valve design, which is substantially simplified when compared to conventional solutions that require multiple valves or complex spool designs.

Within this specification embodiments have been described in a way which enables a clear and concise specification to be written, but it is intended and will be appreciated that embodiments may be variously combined or separated without parting from the invention. For example, it will be appreciated that all preferred features described herein are applicable to all aspects of the invention described herein.

Thus, while the invention has been described in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein.

Various features and advantages of the invention are set forth in the following claims.

I claim:

1. A hydraulic system comprising:

a pump;

a load sense conduit;

a tank conduit in fluid communication with a tank;

a hydraulic function including a function workport;

a function control valve configured to selectively provide fluid communication between the function workport and either the pump or the tank conduit;

a function poppet valve arranged between the function workport and the function control valve and including a function poppet vent passage; and a system control valve arranged downstream of the function control valve, wherein the system control valve is biased into a first position where fluid communication between the function poppet vent passage and the tank conduit is prevented and fluid communication between the load sense conduit and the tank conduit is provided, and wherein the system control valve is selectively movable to a second position where fluid communication between the function poppet vent passage and the tank conduit is allowed and fluid communication between the load sense conduit and the tank conduit is prevented;

wherein when the system control valve is in the first position, operation of the hydraulic function via manipulation of the function control valve is prevented.

2. The hydraulic system of claim 1, wherein when the system control valve is in the first position, the pump is prevented from building pump pressure and the function poppet valve is configured to block fluid flow from the function workport to a function control valve workport of the function control valve.

3. The hydraulic system of claim 1, wherein when the system control valve is in the second position, the pump is allowed to build pump pressure and, when the function control valve is displaced in a first direction, the function poppet valve is configured to allow fluid flow from the function workport to a function control valve workport of the function control valve.

4. The hydraulic system of claim 1, wherein when the system control valve is in the second position, operation of the hydraulic function via manipulation of the function control valve is allowed.

5. The hydraulic system of claim 1, wherein the function poppet valve includes a poppet biased against a seat by a spring and an orifice providing fluid communication between the function workport and a control chamber of the function poppet valve, and wherein the control chamber is in fluid communication with the function poppet vent passage.

6. The hydraulic system of claim 5, wherein when the system control valve is in the first position, pressure from the function workport is communicated to the control chamber through the orifice, which forces the poppet into engagement with the seat and prevents fluid communication from the function workport to the tank conduit.

7. The hydraulic system of claim 6, wherein when the system control valve is in the second position and the function control valve is displaced in a first direction, fluid communication is allowed between the control chamber and the tank, which enables pressure from the function workport to force the poppet off the seat and fluid communication is allowed between the function workport and the tank conduit.

8. The hydraulic system of claim 1, wherein the system control valve is a 3-way, 2-position control valve.

9. The hydraulic system of claim 1, wherein the system control valve is selectively movable from the first position to the second position in response to a positive operator presence indication.

10. The hydraulic system of claim 1, wherein the system control valve is electrically operated.

11. The hydraulic system of claim 1, wherein the system control valve is an electrically-operated solenoid control valve.

12. The hydraulic system of claim 1, wherein the system control valve includes a first port in fluid communication with the function poppet vent passage through the function control valve, a second port in fluid communication with the load sense conduit, and a third port in fluid communication with the tank conduit.

13. A hydraulic system comprising:

a pump including an pump outlet;

a tank conduit in fluid communication with a tank;

a hydraulic function including a function workport;

a function control valve configured to selectively provide fluid communication between the function workport and either the pump or the tank conduit;

a function poppet valve arranged between the function workport and the function control valve and including a function poppet vent passage;

a system control valve arranged downstream of the function control valve; and a pump poppet valve including a pump poppet vent passage, wherein the system control valve is biased into a first position where fluid communication between the function poppet vent passage and the tank conduit is prevented and fluid communication between the pump poppet vent passage and the tank conduit is provided, and wherein the system control valve is selectively movable to a second position where fluid communication between the function poppet vent passage and the tank conduit is allowed and fluid communication between the pump poppet vent passage and the tank conduit is prevented;

wherein when the system control valve is in the first position, operation of the hydraulic function via manipulation of the function control valve is prevented.

14. The hydraulic system of claim 13, wherein when the system control valve is in the first position, the pump is prevented from building pump pressure and the function poppet valve is configured to block fluid flow from the function workport to a function control valve workport of the function control valve.

15. The hydraulic system of claim 13, wherein when the system control valve is in the second position, the pump is allowed to build pump pressure and, when the function control valve is displaced in a first direction, the function poppet valve is configured to allow fluid flow from the function workport to a function control valve workport of the function control valve.

16. The hydraulic system of claim 13, wherein the function poppet valve includes a poppet biased against a seat by a spring and an orifice providing fluid communication between the function workport and a control chamber of the function poppet valve, and wherein the control chamber is in fluid communication with the function poppet vent passage.

17. The hydraulic system of claim 16, wherein when the system control valve is in the first position, pressure from the function workport is communicated to the control chamber through the orifice, which forces the poppet into engagement with the seat and prevents fluid communication from the function workport to the tank conduit.

18. The hydraulic system of claim 17, wherein when the system control valve is in the second position and the function control valve is displaced in a first direction, fluid communication is allowed between the control chamber and the tank, which enables pressure from the function workport to force the poppet off the seat and fluid communication is allowed between the function workport and the tank conduit.

19. The hydraulic system of claim 13, wherein the system control valve is a 3-way, 2-position control valve.

20. The hydraulic system of claim 13, wherein the system control valve is selectively movable from the first position to the second position in response to a positive operator presence indication.

21. The hydraulic system of claim 13, wherein the system control valve is electrically operated.

22. The hydraulic system of claim 13, wherein the system control valve is an electrically-operated solenoid control valve.

23. The hydraulic system of claim 13, wherein the system control valve includes a first port in fluid communication with the function poppet vent passage through the function control valve, a second port in fluid communication with the pump poppet vent passage, and a third port in fluid communication with the tank conduit.

24. The hydraulic system of claim 13, wherein the pump poppet valve includes a pump poppet biased against a seat by a spring and an orifice providing fluid communication between the pump outlet and a pump poppet control chamber of the function poppet valve, and wherein the pump poppet control chamber is in fluid communication with the pump poppet vent passage.

25. The hydraulic system of claim 24, wherein when the system control valve is in the first position, the fluid communication allowed between the pump poppet vent passage and the tank conduit allows fluid communication between the pump poppet control chamber and the tank, which enables pressure from the pump outlet to provide fluid communication between the pump outlet and the tank by forcirg the pump poppet off of the seat and wherein when the system control valve is in the second position, pressure from the pump outlet is communicated to the pump poppet control chamber through the orifice, which forces the pump poppet into engagement with the seat and prevents fluid communication from the pump outlet to the tank conduit through the pump poppet valve.

* * * * *